US008422912B2

(12) United States Patent
Iikura et al.

(10) Patent No.: US 8,422,912 B2
(45) Date of Patent: Apr. 16, 2013

(54) IMAGE FORMING CARTRIDGE AND IMAGE FORMING DEVICE

(75) Inventors: Kazuaki Iikura, Kanagawa (JP); Kaoru Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 322 days.

(21) Appl. No.: 12/876,362

(22) Filed: Sep. 7, 2010

(65) Prior Publication Data

US 2011/0222905 A1 Sep. 15, 2011

(30) Foreign Application Priority Data

Mar. 12, 2010 (JP) ..... 2010-056395

(51) Int. Cl.
*G03G 21/18* (2006.01)

(52) U.S. Cl.
USPC ..... 399/114; 399/102; 399/106; 399/172

(58) Field of Classification Search ..... 399/102, 399/106, 114, 172
See application file for complete search history.

(56) References Cited

U.S. PATENT DOCUMENTS 5,243,384 A * 9/1993 Everdyke et al. ..... 399/116
2010/0054799 A1* 3/2010 Nakamura et al. ..... 399/114

FOREIGN PATENT DOCUMENTS

JP 2002-258719 A 9/2002
JP 2002-311688 A 10/2002

* cited by examiner

*Primary Examiner* — Ryan Walsh
(74) *Attorney, Agent, or Firm* — Sughrue Mion, PLLC

(57) ABSTRACT

An image forming cartridge includes a photoconductor; a charger with a charging member contactable with the photoconductor; a case that accommodates the photoconductor and the charger; a cover which is detachably attached to the case and covers at least a part of the photoconductor; and a separating member which is located, on the cover, between a region other than the region of the photoconductor where an image is formed and the charger and separated them from each other.

8 Claims, 10 Drawing Sheets

IMAGE FORMING CARTRIDGE AND IMAGE FORMING DEVICE

CROSS-REFERENCE TO RELATED APPLICATION

This application is based on and claims priority under 35 USC 119 from Japanese Patent Application No. 2010-056395 filed on Mar. 12, 2010.

BACKGROUND

1. Technical Field

This invention relates to an image forming cartridge with a photoconductor and an image forming device provided with such an image forming cartridge.

2. Related Art

Traditionally, there have been proposed a photoconductor unit equipped with a photoconductor and a charging roller and a process cartridge equipped with a photoconductor, a charging roller and developer. With the photoconductor and charging roller being in contact with each other, these devices are shipped as products. This gave rise to an inconvenience that frictional charging occurs between the photoconductor and the charging roller because of vibration during transportation and electrostatic memory is left on the photoconductor to generate a poor image.

SUMMARY

According to an aspect of the invention, an image forming cartridge includes:

a photoconductor;

a charger with a charging member contactable with the photoconductor;

a case that accommodates the photoconductor and the charger;

a cover which is detachably attached to the case and covers at least a part of the photoconductor; and a separating member which is located, on the cover, between a region other than the region of the photoconductor where an image is formed and the charger and separated them from each other.

BRIEF DESCRIPTION OF THE DRAWINGS

Exemplary embodiments of the invention will be described in detail based on the following figures, wherein.

DETAILED DESCRIPTION

Figure 1:
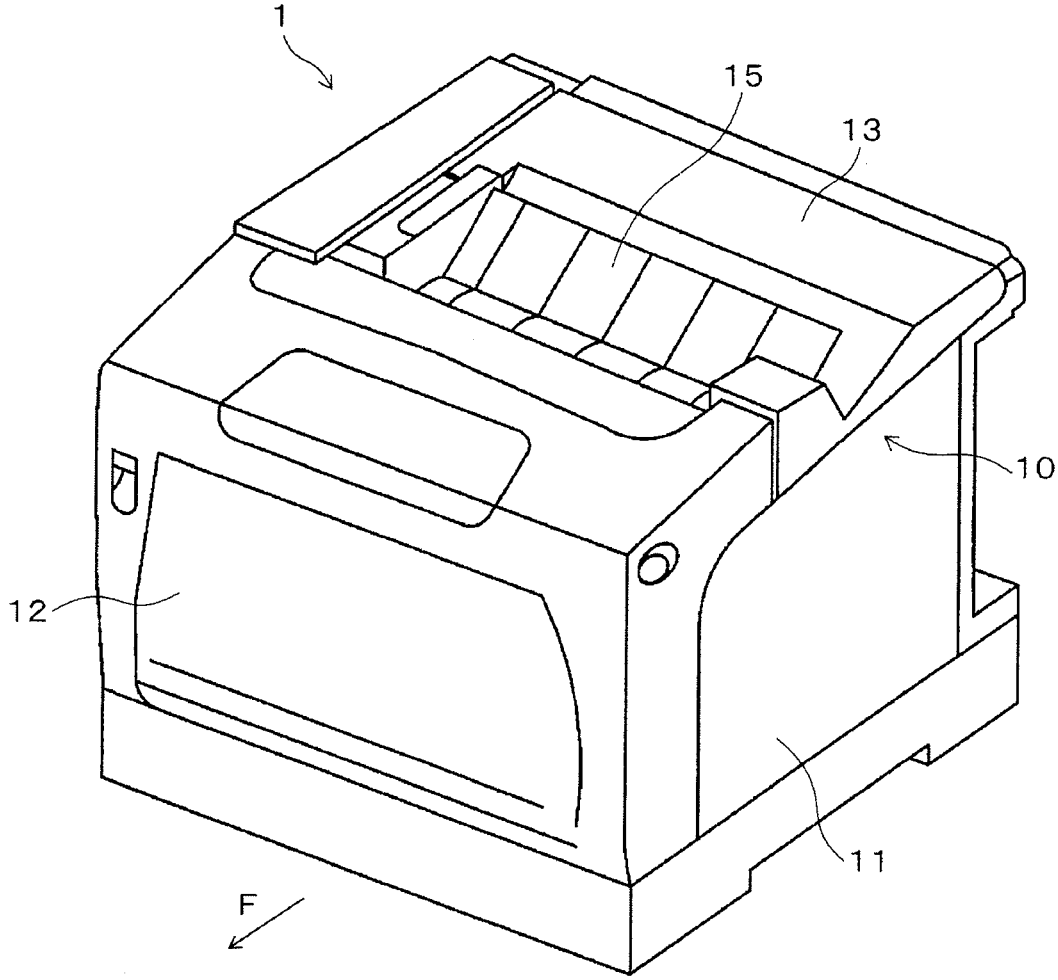
FIG. 1 is a perspective view of a printer according to an exemplary embodiment of this invention.

Hereinbelow, referring to the drawings, an exemplary embodiment of this invention will be explained.

(1) Basic Structure and Operation of the Printer

First, an explanation will be given of the basic structure and operation of a printer (image forming device) according to an exemplary embodiment of this invention.

Figure 2:
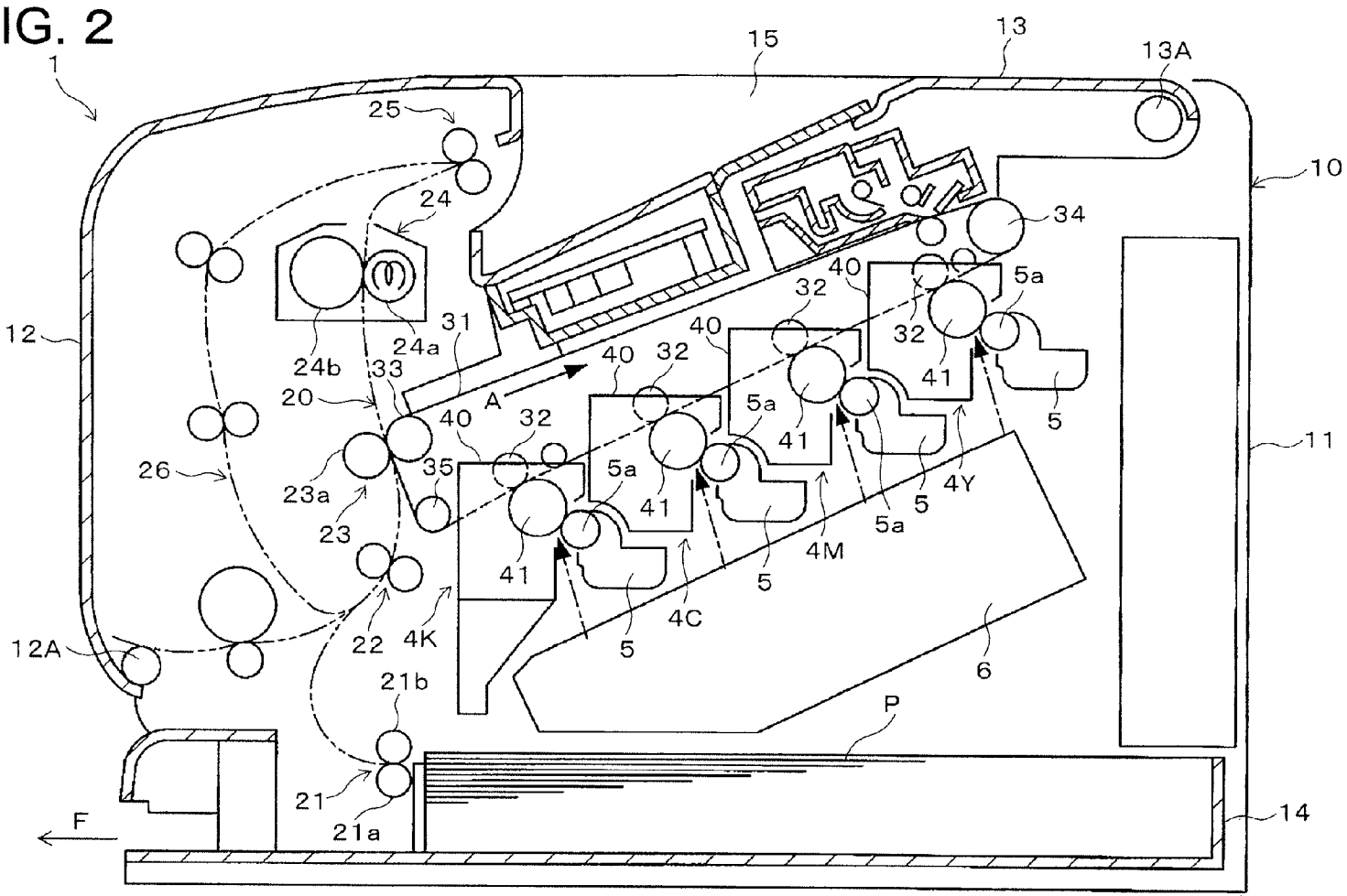
FIG. 2 is a sectional view of a printer according to an exemplary embodiment of this invention.
Figure 3:
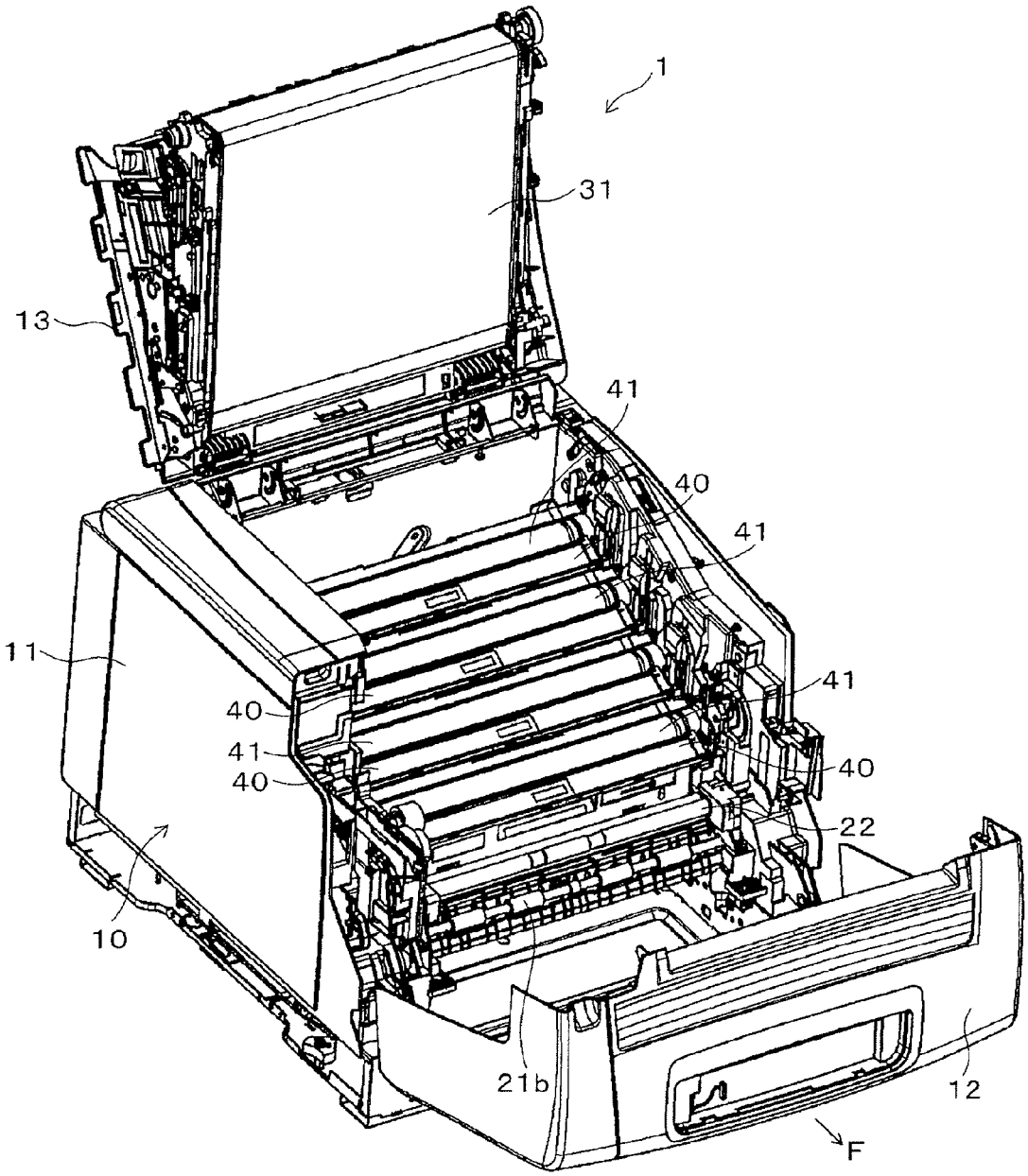
FIG. 3 is a perspective view of the printer in the state where its cover is opened according to an exemplary embodiment of this invention.
Figure 4:
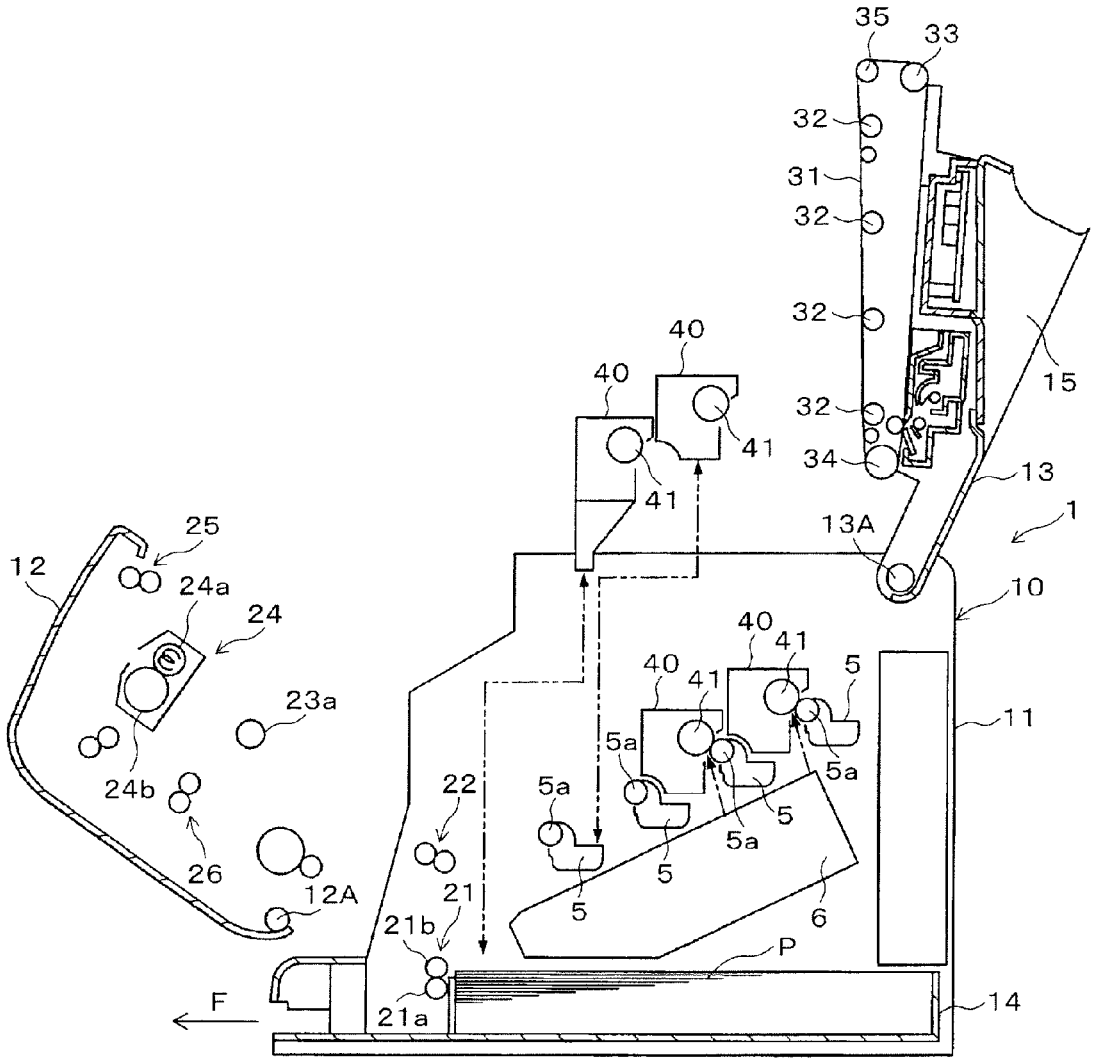
FIG. 4 is a sectional view of the printer in the state where its cover is opened according to an exemplary embodiment of this invention.

FIG. 1 shows the external appearance of a printer 1 according to an exemplary embodiment of this invention. FIG. 2 is the internal structure of the printer 1. In these figures, a reference symbol 10 denotes a device body having a box 11. The device body 10, as shown in FIGS. 3 and 4, has an opening in the region extending from the top to the front (the front is an F direction in FIGS. 1 to 4). This opening is opened/closed by a front cover 12 and an upper cover 13. The front cover 12 is formed in an inverted L-shape in section covering the front and top front of the device body 10. As shown in FIG. 2, its lower end is hinge-connected to the device body 10 through a hinge axis 12A extending in a right-and-left direction (front-and-rear direction of the drawing of FIG. 2) and opened/closed so as to lean in a fore-and-aft direction). Further, the lower end of the upper cover 13 is hinge-connected to the device body 10 through a hinge axis 13A which is in parallel to the hinge axis 12A and opened/closed so as to rotate in an up-and-down direction.

As seen from FIG. 2, on the bottom, the device body 10 is provided with a sheet housing 14 for housing a larger number of sheets P stacked. The sheet P to be subjected to printing ascends along a sheet transporting path 20 formed at the front side in the device body 10 and is exhausted into an exhaust tray 15 formed at the upper part of the upper cover 13.

The printer 1 is a tandem-type full color printer. The device body 10 thereof, as shown in FIG. 2, incorporates a transfer belt 31 which is stretched rotatably and forward-downward tilting (left-downward in FIG. 2) and rotates in an arrow A direction; four-color image forming units 4Y, 4M, 4C and 4K which are arranged in parallel beneath the transfer belt 31; a secondary transfer unit 23 and a fixing unit 24, etc. The image forming units 4Y, 4M, 4C and 4K are arranged in parallel to the tilting direction of the transfer belt 31.

The four image forming units 4Y, 4M, 4C and 4K serve to form toner images of yellow (Y), magenta (M), cyan (C) and black (K), and their basic structures are the same as one another. The image forming units each includes a photoconductor unit (image forming cartridge) 40 having a photoconductor drum (also simply referred to as a photoconductor) 41 as a main part, and a developer 5. The photoconductor unit 40 is removably set in the device body 10 from above whereas the developer 5 is fixed to the device body 10 side. It should be noted that the photoconductor unit 40 is a special feature of this exemplary embodiment and will be explained later in detail.

Beneath the image forming units 4Y, 4M, 4C and 4K, an image exposing device 6 common to the image forming units 4Y, 4M, 4C and 4K are arranged. The image exposing device 6 has four semiconductor lasers (not shown) which emit laser beams modulated according to image data of the respective colors of Y, M, C and K.

Color image information is inputted into the printer 1 from e.g. a personal computer. Then, four laser beams according to the respective colors are emitted from the semiconductor lasers in the image exposing device 6. These laser beams are deflected by polygonal mirrors and thereafter scan the surfaces of the photoconductor drums 41 rotating and charged of the image forming units 4Y, 4M, 4C and 4K through lenses and mirrors (not shown). Thus, the latent images of the respective colors are formed on the photoconductor drums 41.

The latent images formed on the photoconductor drums 41 are developed by the developers 5 using developing agents containing the respective color toners; the toner images thus developed (color images) are primary-transferred onto the outer surfaces of the transfer belts 31 by primary transfer rollers 32 rotating. Such a primary transfer operation of the development from the photoconductor 41 to the transfer belt 31 is sequentially executed in each of the image forming units 4Y, 4M, 4C and 4K at predetermined timings. When the transfer belt 31 passes the image forming unit 4K at the most downstream side, a full color toner image is formed on the outer surface of the transfer belt 31.

The transfer belt 31, as shown in FIGS. 3 and 4, is provided on the upper cover 13 side; when the upper cover 13 is closed, as shown in FIG. 2, it is arranged at the position opposite to each of the image forming units 4Y, 4M, 4C and 4K and the primary transfer rollers 32 form nips with the photoconductor belts 41 to cross the transfer belt 31. The transfer belt 31 is wound on a driving roller 33, a tension roller 34 and a follower roller 35, and rotates in an arrow A direction when the driving roller 33 rotates.

Further, referring to FIG. 2, in a secondary transfer unit 23, the full color toner image on the transfer belt 31 is transferred onto a sheet P which is pulled out from the sheet housing 14 by a sheet supplier 21 and ascends along a sheet transporting path 20 at an appropriate timing. The sheet supplier 21 is provided with a sheet supplying roller 21*a* and a sheet separating roller 21*b*. The sheets P are separated one by one by the sheet supplier 21; the sheet P is once transported from the sheet housing 14 to a pair of resist rollers 22 and stopped. By the pair of resist rollers 22 which are rotation-driven at predetermined timings, the sheet P is supplied out to the secondary transfer unit 23. The secondary transfer unit 23 is provided with the driving roller 33 which stretches the transfer belt 31 and a secondary transfer roller 23*a* forming a nip with the driving roller 33. When the sheet P passes between these rollers 33 and 23*a*, the full color toner image on the transfer belt 31 is transferred onto the sheet P.

The sheet P with the full color toner image transferred passes a fixing unit 24 where the full color toner image is fixed on the sheet P. The fixing unit 24 includes a heating roller 24*a* and a pressurizing roller 24*b* which forms a nip with the heating roller 24*a*. When the sheet P passes between these rollers 24*a* and 24*b*, the full color toner image is fixed on the sheet P by the action of pressurizing and heating. Further, the sheet P having passed the fixing unit 24 is exhausted into an exhausting tray 15 by a pair of exhaust rollers 25. The sheet transporting path 20 is a path from the sheet supplier 21 to the pair of exhaust rollers 25 via the pair of resist rollers 22, secondary transfer unit 23 and fixing unit 24.

It should be noted that on the front side of the sheet transporting path 20, there is provided a sheet inverting mechanism 26 for inverting the front/back of the sheet P. As shown in FIG. 4, the sheet inverting mechanism 26 is provided on the front cover 12 side. Further, the secondary transfer roller 23*a* of the secondary transfer unit 23, fixing unit 24 and pair of exhaust rollers 25, which constitute the sheet transporting path 20, are supported on the front cover 12 side and tilt integrally with the front cover 12.

(2) Construction of the Photoconductor Unit

Figure 5:
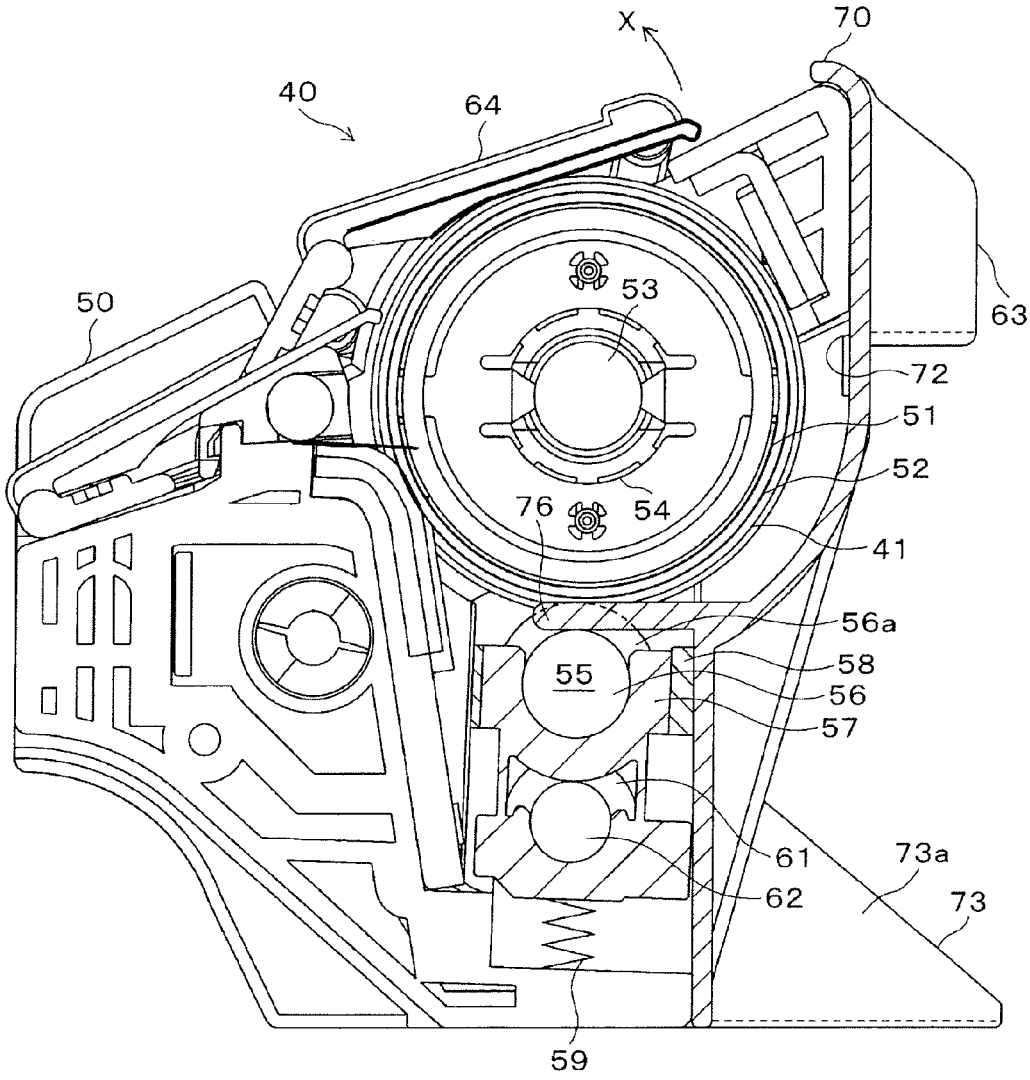
FIG. 5 is a sectional view of an image forming cartridge of the printer according to an exemplary embodiment of this invention.

Next, referring to FIGS. 5 to 7, an explanation will be given of the photoconductor unit 40 according to an exemplary embodiment of this invention. In FIG. 5, a reference symbol 50 denotes a case of the photoconductor unit 40. In the case 50, a photoconductor 41 is rotatably supported. The photoconductor 41 is a cylindrical core 51 whose outer periphery is covered with a predetermined resin 52. It is made rotatable in such a manner that the axes 53 at both ends of the core 51 are supported by bearings 54.

In the case 50, a charging roller 55 is rotatably supported. The charging roller 55 is an axis 56 (see FIG. 5) whose outer periphery is covered with a rubber layer 56*a*. The axis 56 is rotatably supported by a bearing 57. The bearing 57 is movably supported by a guide 58 provided in the case 50 in an up-and-down direction (direction approaching/leaving the photoconductor 41) and also pressed toward the photoconductor 41 side by a spring 59.

Further, in the case 50, a cleaner 61 is rotatably supported. The cleaner 61 is an axis 62 whose outer periphery is covered with cloth or sponge. Its outer periphery always keeps in contact with the charging roller 55. Under the construction described above, the charging roller 55 as well as the cleaner 61 may approach/leave the photoconductor 41 so that the charging roller 55 may touch with and detach from the photoconductor 41.

Figure 6A:
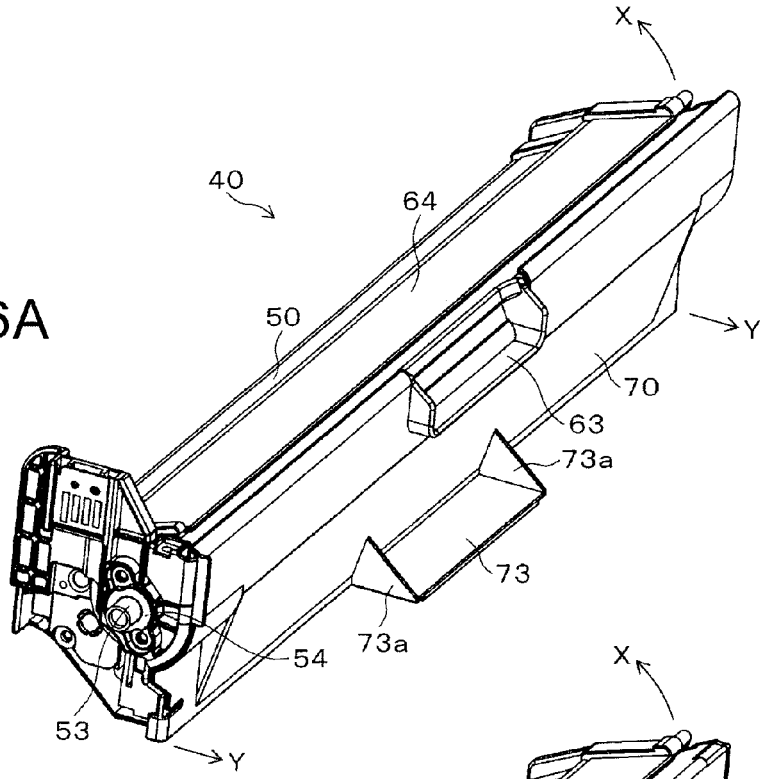
FIGS. 6A and 6B are perspective views of an image forming cartridge of the printer according to an exemplary embodiment of this invention.
Figure 6B:
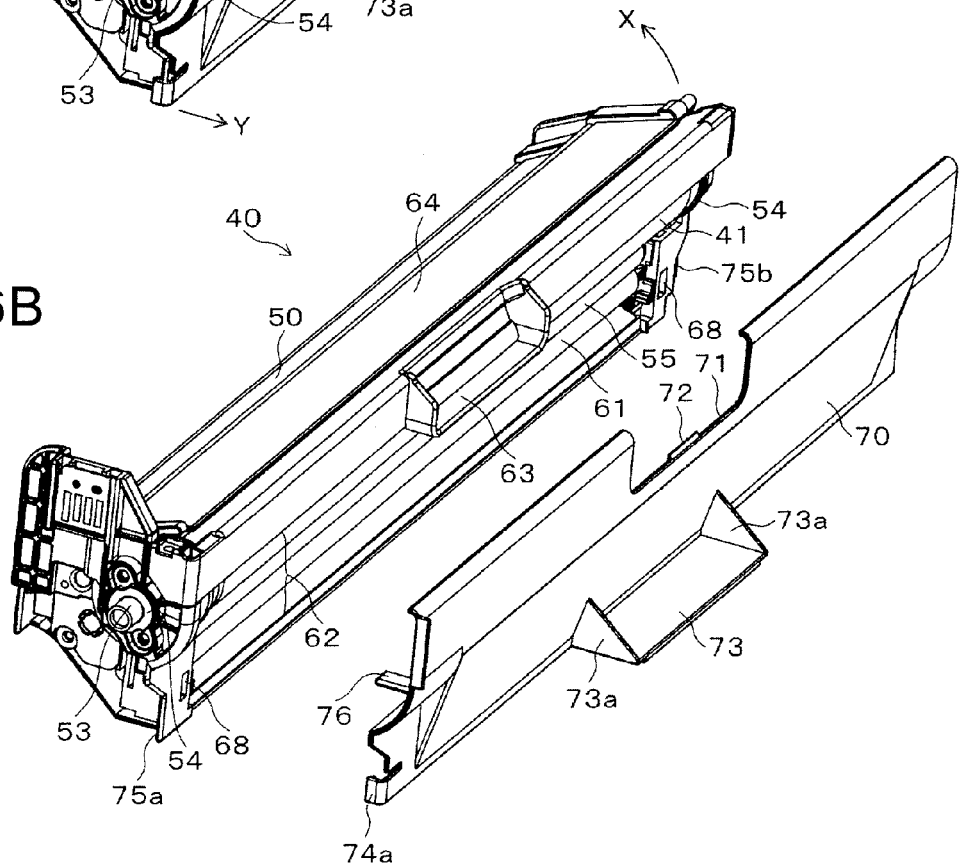
Figure 7:
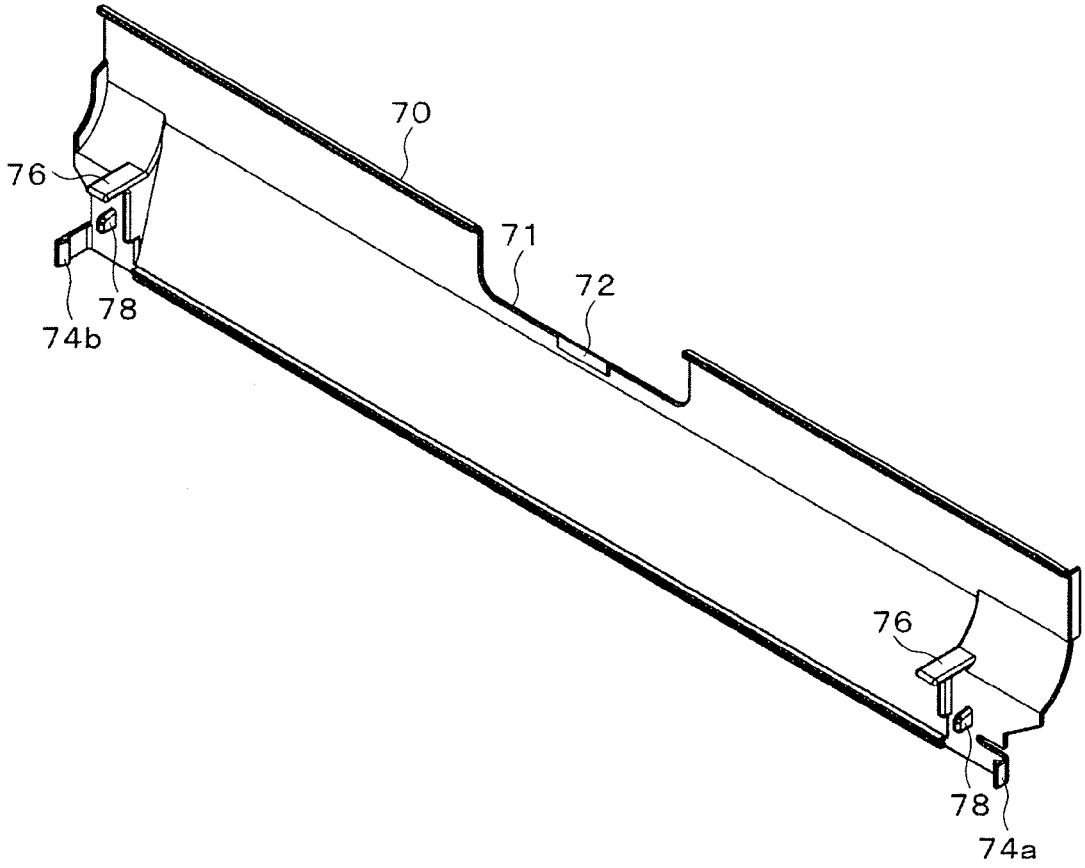
FIG. 7 is a perspective view of a cover of the image forming cartridge according to an exemplary embodiment of this invention when viewed from its back side.

As shown in FIGS. 6A and 6B, on the side of the case 50 (forward side of the printer 1), an opening 62 is formed so that the photoconductor 41, charging roller 55 and cleaner 61 are exposed. The developing roller 5*a* of the developer 5 comes in contact with the photoconductor 41 exposed and the latent image is formed by the laser beam emitted from the image exposing device 6. It means that only the photoconductor 41 may be exposed while the charging roller 55 and cleaner 61 may be covered with the wall of the case 50. However, in this exemplary embodiment, such a wall is not formed to decrease the interval between the photoconductor units 40 and the distance between the photoconductor unit 40 and developer 5, thereby downsizing the printer 1.

On the wall of the case 50 above the opening 62, a handle (first handle) 63 projecting forward is formed. In the drawings, a reference symbol 64 denotes a cap. The cap 64 is opened in an X direction after the photoconductor unit 40 is mounted on the printer 1. Thus, the upper part of the photoconductor 41 is exposed so that when the upper cover 13 is closed, the transfer belt 31 comes in contact with the photoconductor 41.

As shown in FIG. 6B, the case 50 is detachably attached with the cover 70 which covers the photoconductor 41, charging roller 55 and cleaner 61. The cover 70 is made of flexible synthetic resin. At the center of the upper end of the cover 70, a recess 71 which evades the handle 63 is formed. At the lower edge of the recess 71, a projection 72 is formed. On the other hand, on the lower face of the handle 63, a recess (not shown) in which the projection 72 is fit is formed. Further, as shown in FIG. 7, at both ends of the back face of the cover 70, projections 78 projecting toward the case 50 are formed. On the other hand, in the case 50, recesses 78 in which the projections 78 are fit are formed.

At the center of the lower end of the cover 70, a handle (second handle) 73 projecting forward is formed. At both ends of the cover 70, hooks 74*a*, 74*b* which project toward the case 50 are formed. The hook 74*b* is made longer than the hook 74*a*. When the cover 70 is mounted on the case 50, the hooks 74*a*, 74*b* are caught by projections 75*a*, 75*b* formed on the sides of the case 50.

On both sides of the back face of the cover 70, ribs (separating member) 76 are formed to project toward the case 50. As shown in FIG. 5, in the state where the cover 70 is mounted on the case 50, the ribs 76 are located between a region of the resin 52 of the photoconductor 41 where no image is formed and the axis 56 of the charging roller 55 and separate the charging roller 55 and the photoconductor 41 from each other.

(3) Operation of the Photoconductor Unit

In order to attach the cover 70 to the case 50 of the photoconductor unit 40, while the handle 63 of the case 50 is inserted into the recess 71 of the cover 70, the ribs 76 are inserted in between the photoconductor 41 and the axis 56 of the charging roller 55 so that the cover 70 is moved toward the case 50. Further, while the projection 72 of the cover 70 is inserted in a recess (not shown) of the case 50 and the projections 78 are recess 68 of the case 50, the cover 70 is pressed on the case 50. Then, the hooks 74*a*, 74*b* of the cover 70 are caught by the projections 75*a*, 75*b* of the case 50, respectively so that the cover 70 is mounted on the case 50. The photoconductor unit 40 thus completed is shipped as a product. In this case, even if the product suffers from vibration during transportation, since the photoconductor 41 and the charging roller 55 are separated from each other, electrostatic memory due to friction is not generated. In addition, since the cover 70 cover the photoconductor 41, charging roller 55 and cleaner 61, invasion of dust or application of any fingerprint and generation of any flaw are prevented.

In order to mount the photoconductor unit 40 in the printer 1, the cover 70 is removed. At this time, for example the case 50 is grasped by a left hand while the handles 63, 73 are grasped by a right hand. Thus, the center of the handle 73 of the cover 70 is pushed up and the side plates 73*a* of the handle 73 are bent inwardly. In this way, the cover 70 is elastically deformed so that both ends of the cover 70 warp in a Y direction in FIG. 6A. Owing to such deformation of the cover 70, the longer hook 74*b* is removed from the projection 75*b* of the case 50. So, the rib 76 on this side (right side) is slightly pulled out, and next the cover 70 is slightly shifted leftward to extract the shorter hook 74*a* from the projection 75*a*. Further, the cover 70 is pulled out forward so that it is removed from the case 50. Accordingly, the bearing 57 ascends by the action of the spring 59 so that the charging roller 55 is brought into contact with the photoconductor 41.

According to the photoconductor unit 40 having the above construction, the ribs 76 are arranged between the region of the photoconductor 41 where no image is formed and the axis 56 of the charging roller 55, no harmful trace is left on the photoconductor 41. No harmful trace is also left on the rubber layer 56*a* of the charging roller 55. In addition, as in this exemplary embodiment, in the construction in which the photoconductor 41, charging roller 55 and cleaner 61 are exposed, the cover 70 is an important component. Since the cover 70 is also served as a separating member for separating the photoconductor 41 and the charging roller 55 from each other, the number of components does not increase thereby to restrain the production cost.

In the above exemplary embodiment, by grasping the handles 63, 73, the cover 70 is elastically deformed and the hook 74*b* is removed from the projection 75*b* of the case 50. Thus, the cover 70 may be easily removed from the case 50. Further, since this operation is done using both hands, there is less fear of inadvertently touching the photoconductor 41 and the like.

(4) Another Exemplary Embodiment

Next, referring to FIGS. 8 to 10C, another exemplary embodiment of this invention will be explained. In this exemplary embodiment, the photoconductor unit 40 is inserted from the side of the printer 1 and a cover 80 is removably adapted in such a manner that it is slid leftward for the case 50. In the following explanation, with like reference symbols referring to like constituent elements in the above exemplary embodiment, they will not be explained.

Figure 9A:
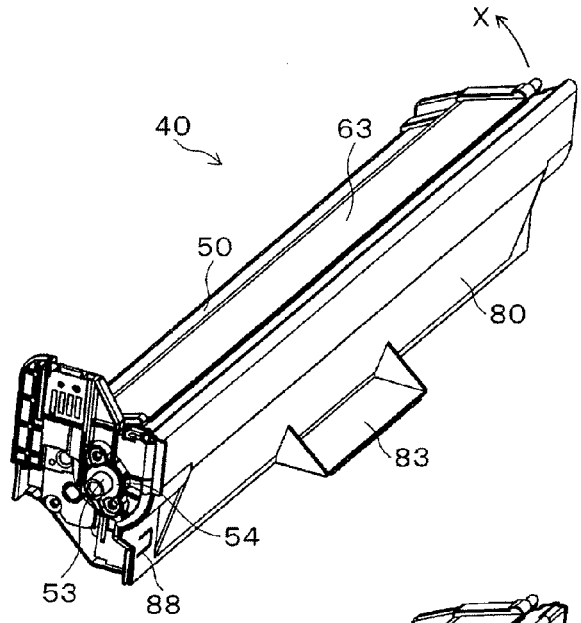
FIGS. 9A and 9B are perspective views of an image forming cartridge according to the printer according to another exemplary embodiment of this invention.
Figure 9B:
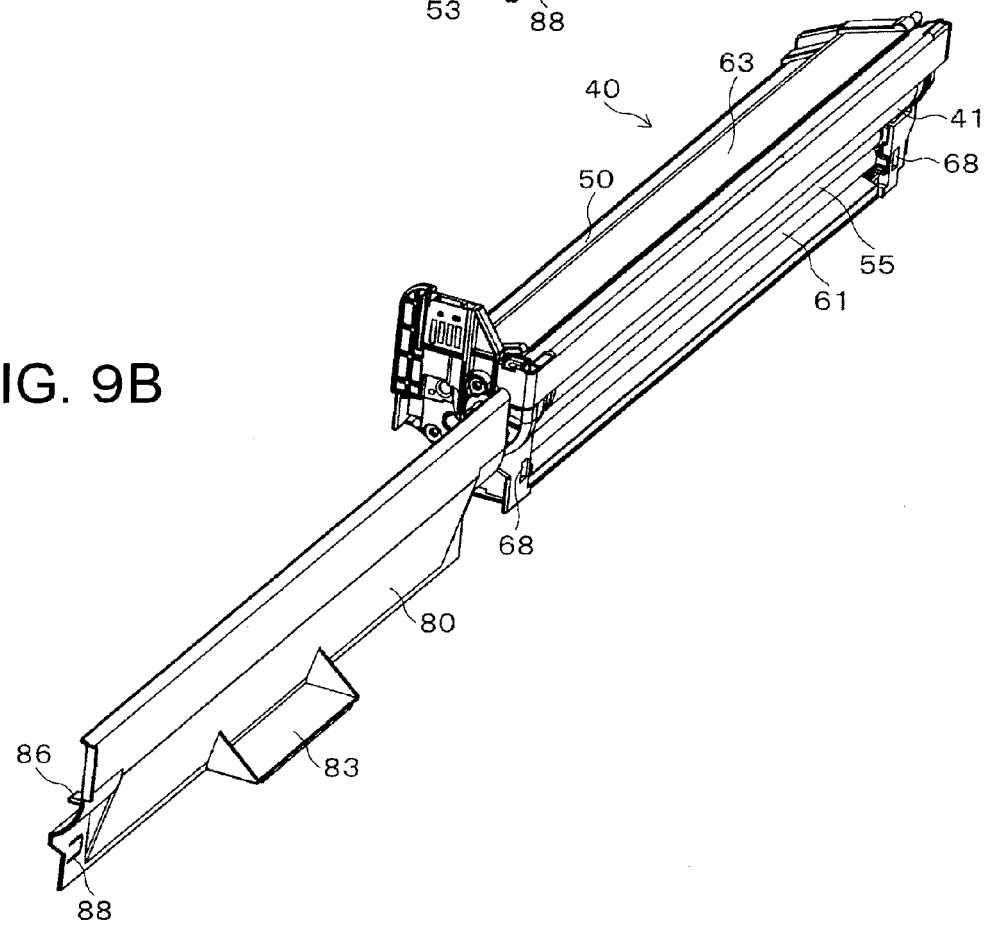

As shown in FIGS. 9A and 9B, the cover 80 is detachably attached to the case 50. The cover 80 covers the photoconductor 41, charging roller 55 and cleaner 61. The cover 80 is made of flexible synthetic resin.

Figure 10A:
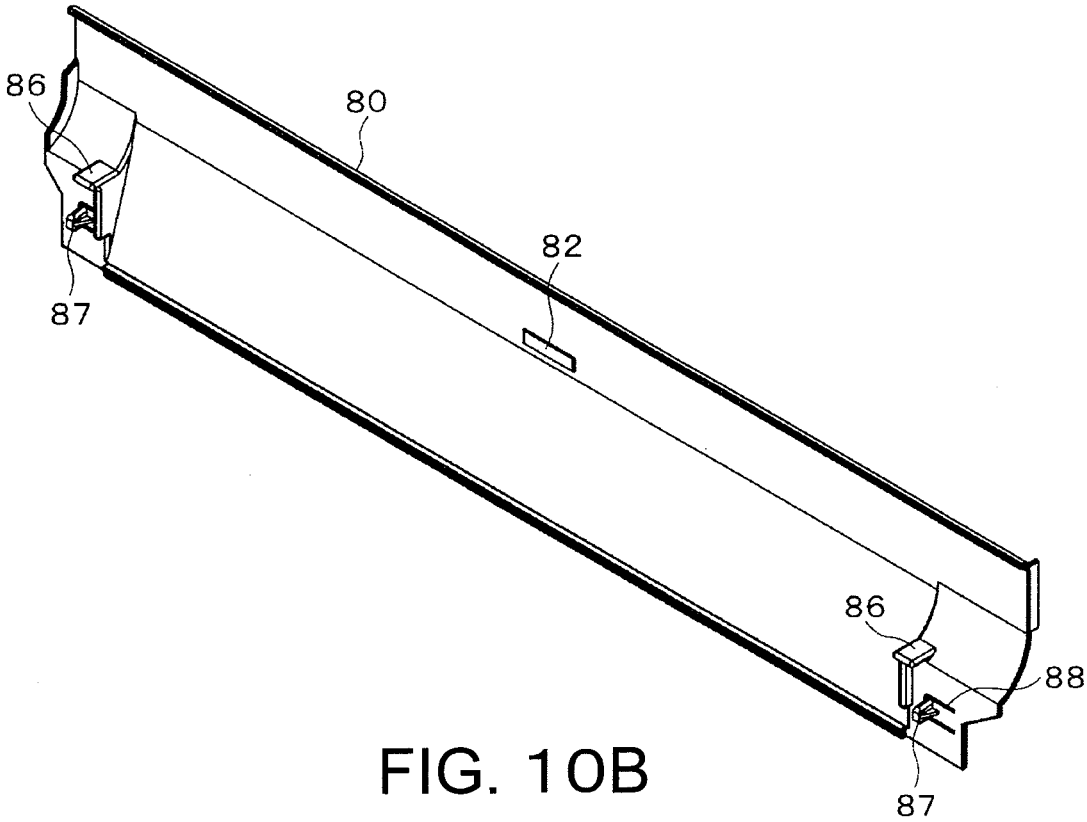
FIG. 10A is a perspective view of a cover of the image forming cartridge according to another exemplary embodiment of this invention and FIGS. 10B and 10C are detail views of FIG. 10A.
Figure 10B:
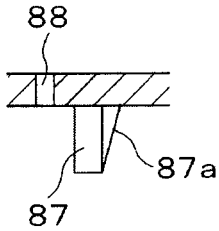
Figure 10C:
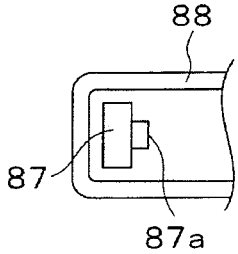

As shown in FIGS. 10A to 10C, a projection 82 is formed at the center of the back face of the cover 80. The recess (not shown) of the case 50 in which the projection 82 is fit is hollow at least on the left side so that the projection 82 may be slid leftward thereby to be removed from the recess not shown. Further, at both ends of the back face of the cover 80, elastic projections 87 are formed which project toward the case 50 to be fit in the recesses 68. On the right side of the elastic projection 87, a slope 87*a* sloping rightward is formed. Around the elastic projection 87, a U-shape slit 88 is formed.

Figure 8:
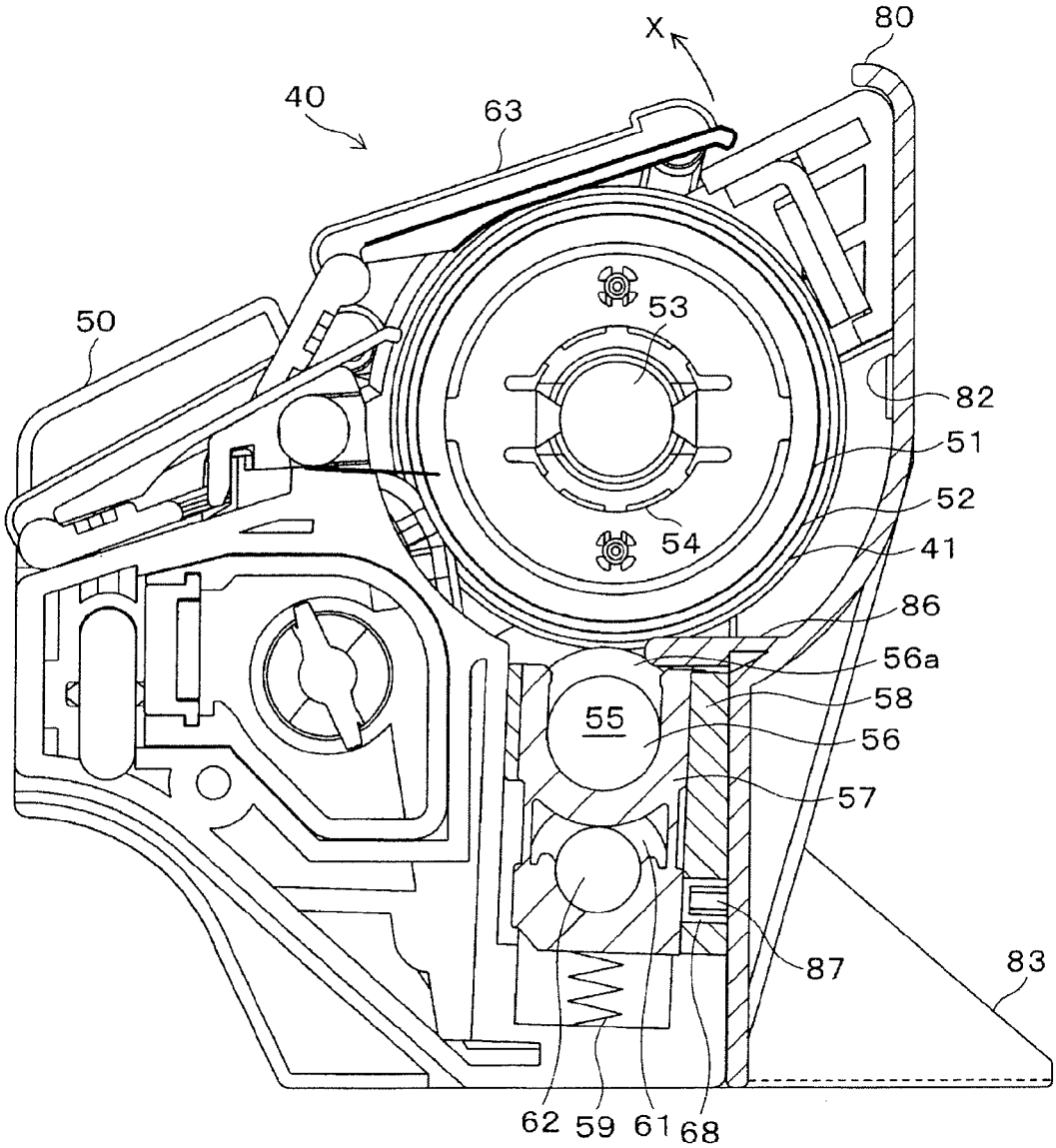
FIG. 8 is a sectional view of an image forming cartridge according to the printer according to another exemplary embodiment of this invention.

At the center of the lower end of the cover 80, a handle 83 projecting forward is formed. On both ends of the back face of the cover 80, ribs (separating members) 86 are formed to project toward the case 50. As shown in FIG. 8, in the state where the cover 80 is mounted on the case 50, the ribs 86 are located between a region of the resin 52 of the photoconductor 41 where no image is formed and the axis 56 of the charging roller 55 and separate the charging roller 55 and the photoconductor 41 from each other.

In order to attach the cover 80 to the case 50 of the photoconductor unit 40, the ribs 86 are inserted in between the photoconductor 41 and the bearing 57 of the charging roller 55 and the cover 80 is moved toward the case 50. Further, while the projection 82 of the cover 80 is inserted in the recess (not shown) of the case 50 and the elastic projections 87 of the cover 80 are inserted into the recesses 68 of the case 50, the cover 80 is pressed on the case 50. In this way, the cover 80 is mounted on the case 50. The photoconductor unit 40 thus completed have the same operation and effect as that according to the above exemplary embodiment.

In order to mount the photoconductor unit 40 in the printer 1, the photoconductor unit 40 is inserted into an insertion mouth formed on the side of the printer 1. In this case, since the printer 1 is provided with a member interfering with the cover 80, when the photoconductor unit 40 is inserted into the printer 1, leftward force acts on the cover 80. Then, the slope 87*a* of the elastic projection 87 is pushed on the wall of the recess 68 of the case 50 so that forward force acts on the elastic projection 87.

Thus, by the action of the slit 88 formed around the elastic projection 87, its interior warps forward so that the elastic projection 87 leaves from the recess 68. At the same time, a projection 82 formed on the back face of the cover 80 leaves the recess not shown and also the rib 86 leaves from between the photoconductor 41 and the bearing 57. Accordingly, the bearing 57 ascends by the action of the spring 59 so that the charging roller 55 is brought into contact with the photoconductor 41. In this state, the cover 80 is off the case 50 so that the cover 80 may be removed by the hand.

According to the photoconductor unit 40 having the above construction, if the photoconductor unit 40 is inserted into the printer 1, the cover 80 automatically comes off. So, a mistake of mounting with the cover 80 being attached may be prevented.

This invention may be applied to an image forming device such as a copier, a printer, a facsimile, and a composite machine thereof.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming cartridge comprising:

a photoconductor;

a charger with a charging member contactable with the photoconductor;

a case that accommodates the photoconductor and the charger;

a cover which is detachably attached to the case and covers at least a part of the photoconductor; and a separating member that projects from the cover and is located between a region of the photoconductor and the charger to separate them from each other, the region of the photoconductor is outside an image forming region;

wherein the case is provided with a first handle adjacent to a side where the cover is attached and the cover is provided with a recess evading the first handle and with a second handle opposite to the first handle and when the first and second handles are grasped, the cover is elastically deformed to separate from the of the case.

2. The image forming cartridge according to claim 1, where the cover covers entirety of the photoconductor and the charger.

3. The image forming cartridge according to claim 1, wherein the charger is a charging roller having an axis whose outer periphery is covered with a charging layer and the separating member is inserted between the axis and the photoconductor.

4. The image forming cartridge according to claim 1, wherein at both ends of the cover, there are provided hooks which project toward the case and are detachably caught by the sides of the case, and when the first and second handles are grasped, the cover is elastically deformed so that at least one of the hooks is separated from the side of the case.

5. The image forming cartridge according to claim 1, wherein a charging roller is rotatably supported by a bearing in the case;

the bearing is capable of approaching/leaving the photoconductor and is pressed toward the photoconductor; and the separating member is inserted between the bearing and the photoconductor.

6. The image forming cartridge according to claim 1, wherein the cover is attachable/detachable for the case so that the cover is moved from the case in an axial direction of the photoconductor.

7. An image forming device comprising:

an image forming unit that forms a toner image, the image forming unit including an image forming cartridge according to claim 1 and being provided in a state where the cover is removed from the image forming cartridge, a transfer unit that transfers the toner image formed by the image forming unit to a recording sheet; and a fixing unit that fixes the toner image transferred on the recording sheet.

8. The image forming device according to claim 7, wherein the image forming cartridge is mounted on a body of the image forming device from above the body.

* * * * *